US005363620A

United States Patent [19]

Liu

[11] Patent Number: 5,363,620

[45] Date of Patent: Nov. 15, 1994

[54] STONE MOUNTING MEMBER

[76] Inventor: Han-Du Liu, 2nd Fl., No. 36, Yung Fu St., Taipei, Taiwan, Prov. of China

[21] Appl. No.: 23,406

[22] Filed: Feb. 26, 1993

[51] Int. Cl.[5] ..... E04B 2/00

[52] U.S. Cl. ..... 52/482; 52/483.1; 52/468; 52/586.1; 403/405.1; 403/357

[58] Field of Search ..... 52/214, 204.53, 204.54, 52/204.55, 468, 470, 481–487, 489, 714, 586, 587, 588, 281, 483.1, 489.2, 489.3, 586.1, 586.2; 403/405.1, 406.1, 357

[56] References Cited

U.S. PATENT DOCUMENTS

| | | | |
|---|---|---|---|
| 876,399 | 1/1908 | Robinson | 52/482 |
| 2,144,700 | 1/1939 | Barnett | 52/714 |
| 2,150,459 | 3/1939 | Reintjes | 52/487 |
| 3,561,180 | 2/1971 | Wise | 52/468 |
| 3,729,889 | 5/1973 | Baruzzini | 52/586 |
| 4,031,675 | 6/1977 | Roberts et al. | 52/586 |
| 4,270,327 | 6/1981 | Van Leeuwen | 52/714 |
| 4,617,770 | 10/1986 | Hickman | 52/214 |
| 4,648,229 | 3/1987 | Limp | 52/484 |
| 4,660,348 | 4/1987 | LaLonde | 52/489 |

*Primary Examiner*—Carl D. Friedman
*Assistant Examiner*—Winnie Yip
*Attorney, Agent, or Firm*—Robbins, Berliner & Carson

[57] ABSTRACT

A stone/mount combination being mountable to a wall. The stone/mount combination consists of a stone and two mounts. The stone has two parallel edges in each of which a slit is defined. Each mount has a body, a number of fine perpendicularly extending from an edge of the body and a flange perpendicularly extending from an opposite edge of the body. The flange formed on each mount is secured, by means of an adhesive material, in a corresponding slit defined in the stone. Each fin defines a number of apertures. A plurality of screws are inserted through the apertures. A plurality of screws are inserted through the apertures defined through the fins and are further secured to the wall.

4 Claims, 8 Drawing Sheets

STONE MOUNTING MEMBER

BACKGROUND OF THE INVENTION

The present invention relates to a stone mounting member and, more particularly, to a mounting member for mounting a decorative stone, such as marble or granite, onto a wall of a building.

Stones, such as marbles and granites, are widely used in decorating inside and/or outside walls of buildings. Various methods are used to mount the stones onto the walls to be decorated. These methods are, however, cumbersome, inefficient, time-consuming, and require experienced persons to deal with.

Therefore, there has been a long and unfulfilled need for a stone mounting element to mitigate and/or obviate the above-mentioned drawbacks.

SUMMARY OF THE INVENTION

The present invention provides a stone/mount combination being mountable on and detachable from a frame being attached to a wall. The stone/mount combination consists of a stone and two mounts. The stone has two parallel edges in each of which a slit is defined. Each mount has a body, a number of fins perpendicularly extending from an edge of the body and a flange perpendicularly extending from an opposite edge of the body. The flange formed on each mount is secured, by means of an adhesive material, in a corresponding slit defined in the stone. Each fin defines a number of apertures. A plurality of screws are inserted through the apertures defined through the fins and are further secured to the wall.

Other objects, advantages, and novel features of the invention will become more apparent from the following detailed description when taken in conjunction with the accompanying drawings.

DETAILED DESCRIPTION OF THE PREFERRED EMBODIMENTS

Figure 7:
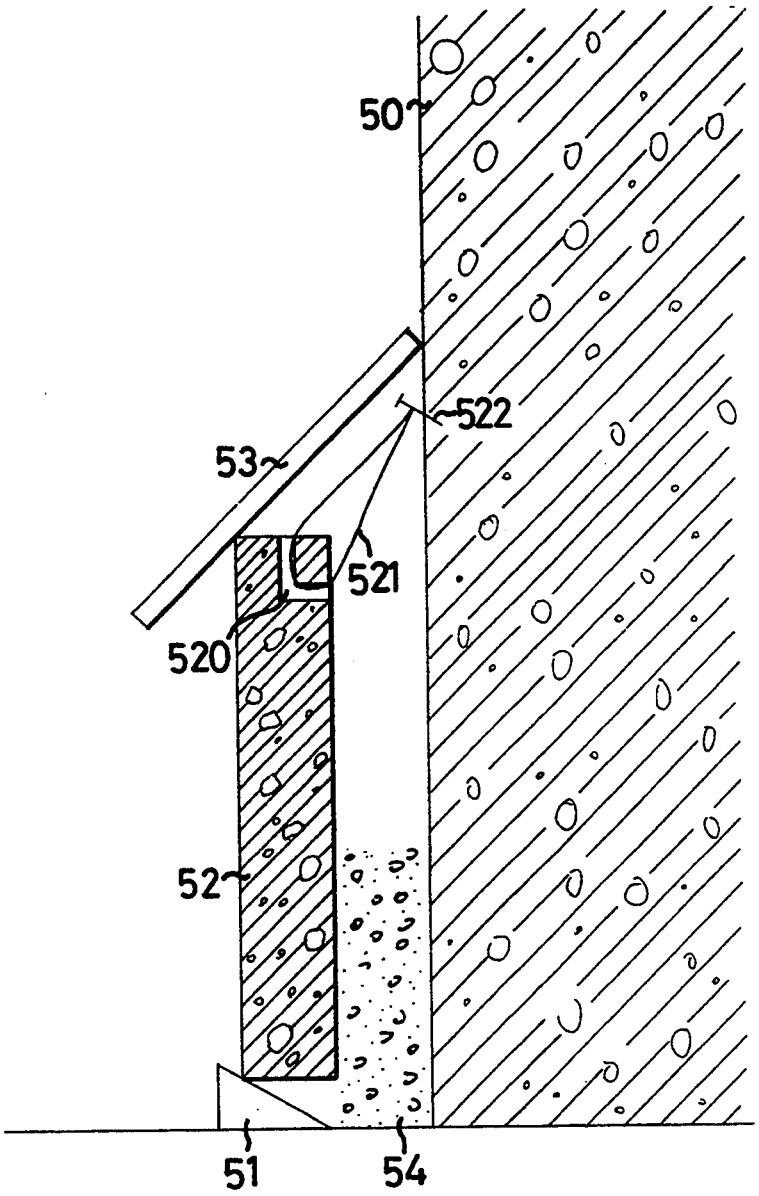
FIG 7 PRIOR ART
FIG. 7 is a partial cross-sectional view illustrating a conventional method for fixing stones onto a wall.
Figure 8:
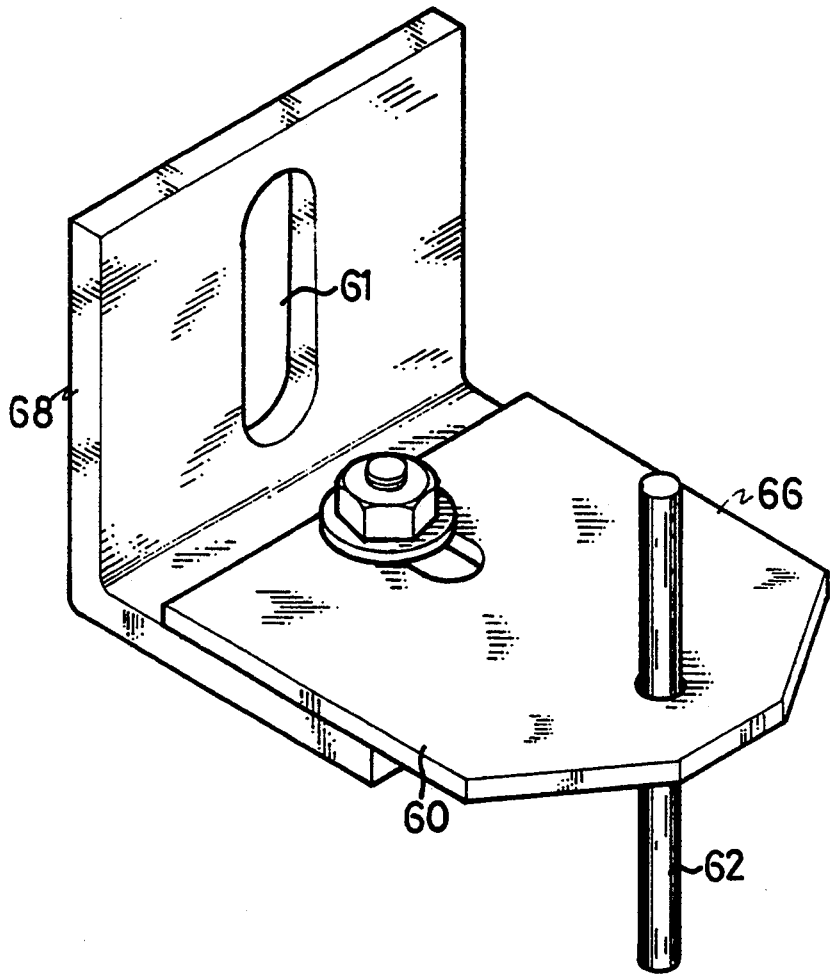
FIG 8 PRIOR ART
FIG. 8 is a perspective view showing a conventional device for fixing stones onto a wall.
Figure 9:
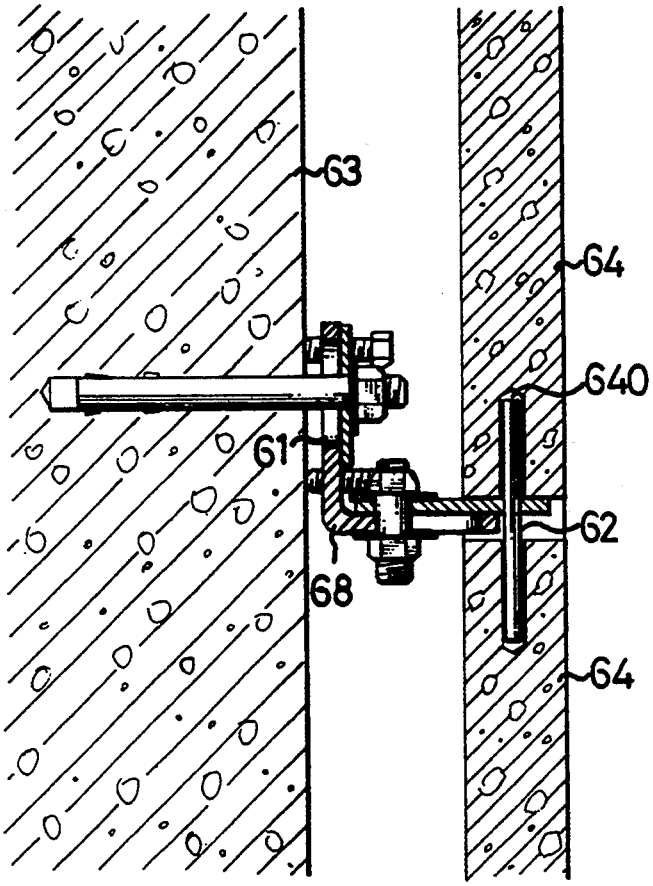
FIG 9 PRIOR ART
FIG. 9 is a partial cross-sectional view illustrating the mounting of stones onto a wall by the device in FIG. 8.

For a better understanding of the present invention, reference is made to FIGS. 7 through 9 which show conventional devices for mounting decorative stones, such as marbles and granites, onto a wall. In FIG. 7, a stone 52 is chiseled to form a substantially L-shaped hole 520 therein to allow an iron wire 521 to pass through which cooperates with a nail 522 to retain the stone 52. A space left between the stone 52 and the wall 50 is filled with mortar 54. The stone 52 is supported by a triangular pad 51 at a bottom thereof. I addition, a positioning plate 53 is placed on a top of the stone 52 to retain the stone 52 in position. After the mortar 54 is set, the mounting of the stone 52 is completed. Such a procedure is repeated to mount all of the stones onto the wall. It is found that the above-mentioned procedure is cumbersome and inefficient. In addition, locating the positioning plate 53 requires an experienced person. Furthermore, the stones are mounted layer by layer and it takes six to eight hours for the mortar 54 (of a lower layer) to set, during which it is impossible to proceed with further mounting of other stones for an upper layer.

FIG. 8 shows another device 60 for mounting stones, including a L-shaped member 68 with an elongate hole 61 on a vertical portion thereof and a plate 66 mounted to a horizontal portion thereof. A pin 62 passes through a hole in the plate 66. As shown in FIG. 9, when mounting the stones 64 onto a wall 63, each of the stones 64 must be chiseled to form a receptacle 640 to receive the pin 62. For accuracy, it still requires an experienced person to proceed with the formation of the receptacles.

In addition to the drawbacks of the above-mentioned methods for mounting decorative stones, the application thereof is also limited as they can only be applied to reinforced concrete walls or brick walls.

Figure 10:
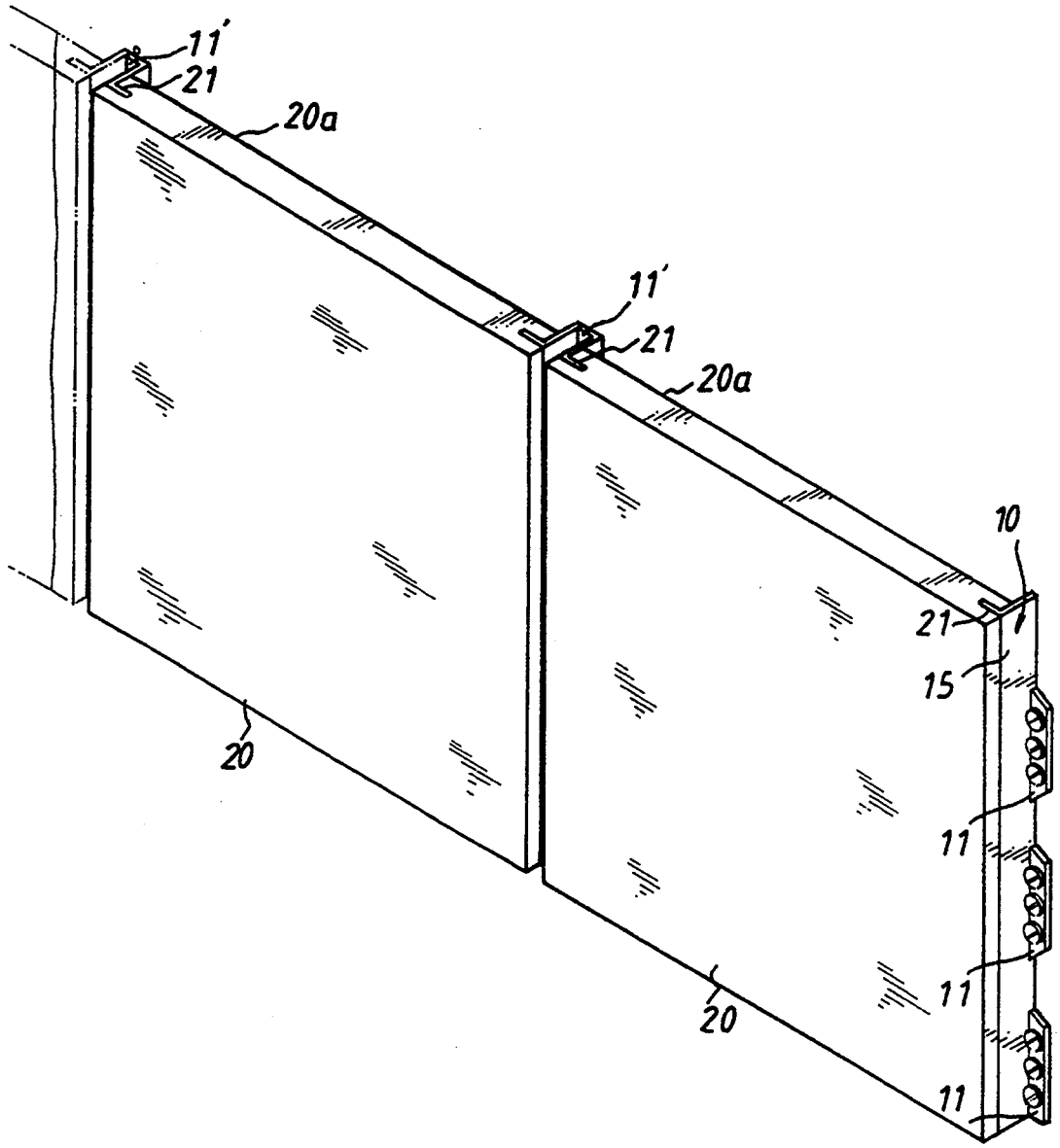
FIG. 10 is a perspective view of a stone being mounted by means of a mount on a wall in accordance with the present invention.
Figure 11:
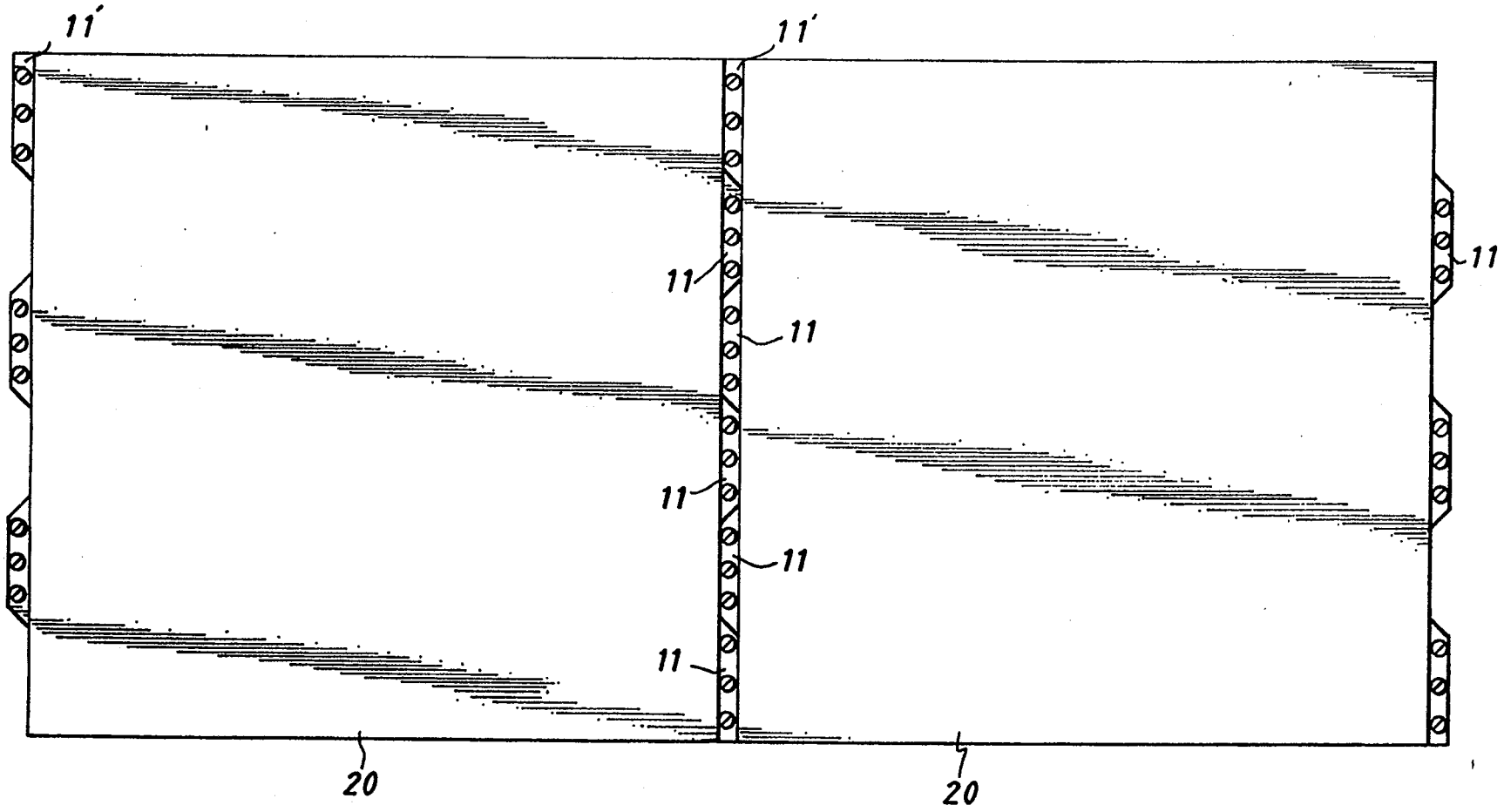
FIG. 11 is a front view of the stone/mount combination as shown in FIG. 10.
Figure 12:
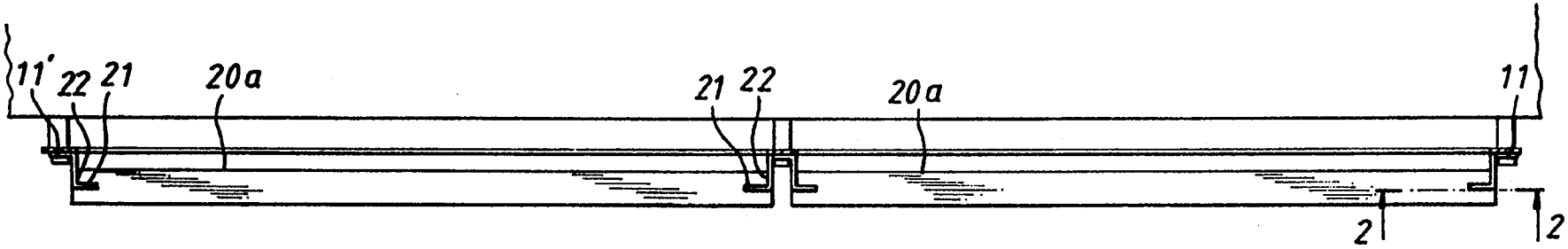
FIG. 12 is a top view of the stone/mount combination as shown in FIG. 11.

Referring to FIGS. 10–12, in accordance with this invention, a stone/mount combination is shown mounted to a wall. The stone/mount combination consists of two mounts 10 and a stone 20. Each mount 10 includes a number of spaced fins 11 through each of which a number of holes 12 are defined. A number of screws are inserted through the holes 12 defined through the fins 11, thus securing the stone/mount combination to the wall.

Figure 1:
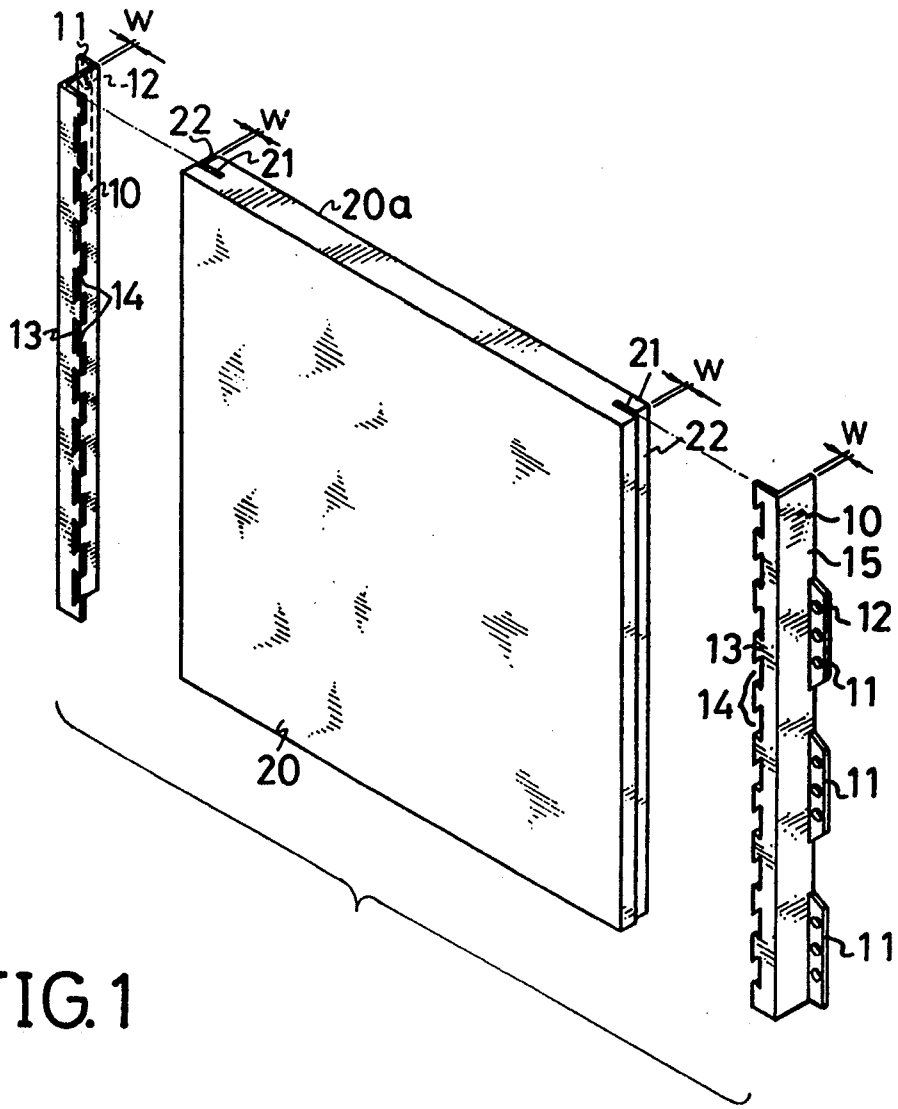
FIG. 1 is a perspective view showing a stone mounting member for fixing a stone onto a wall in accordance with the present invention.
Figure 3:
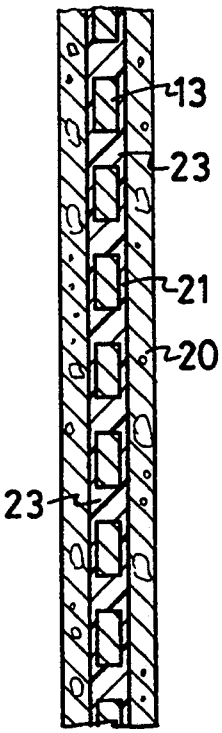
FIG. 3 is a cross-sectional view taken along line 3—3 in FIG. 2.
Figure 2:
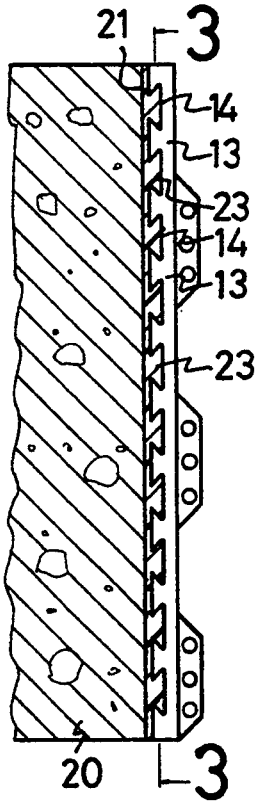
FIG. 2 is a partial cross-sectional view taken from a line 2—2 in FIG. 12.

Referring now to FIGS. 1 through 3, each mount 10 has a body 15, a frame-engaging means perpendicularly extending from an edge of the body 15 and a stone-engaging means perpendicularly extending from an opposite edge of the body 15 so that the stone-engaging means and the frame-engaging means extend in opposite directions. The frame-engaging means consists of the fins 11 through each of which the holes 12 are formed. The fins 11 of one mount 10 match the fins 11 of an adjacent mount 10. The stone-engaging means is a flange 13 in which a number of recesses 14 are formed. The fins 11 are designed such that when rotating the mount through 180°, its position will be in a position shown by the stone mounting member 10' (the reference numerals for corresponding parts are primed) and the mount 10 and 10' can be fittingly mated at the spaced fins 11 and 11' thereof.

The stone 20 to be mounted is cut at a corner thereof to form a notch 22 (the stone is cut by a width which equals the width w of the body 15). A slit 21 extends in the notch 22 along the height of the stone 20 for receiving the flange 13.

When mounting the stone 20, a suitable adhesive material 23 is firstly applied to the slit 21, such that both sides of the flange 13 are bonded in the slit of the stone 20 and the recesses 14 of the flange 13 are filled with the adhesive material 23. A combination of stone/stone mounting member is formed after the adhesive material is set. When a wall is to be decorated, the stone/ mount combination can be easily mounted thereto by simply hammering nails through the holes 12 into the wall. It is appreciated that the stones 20 may be connected along their horizontal sides instead of the connection along their vertical sides. Mounting the right stone onto a wall by mount 10' is the same as that illustrated in the above. It is further appreciated that a layer of insulating material (not shown) may be provided between the surface 20*a* of the stone and the wall surface.

Figure 4:
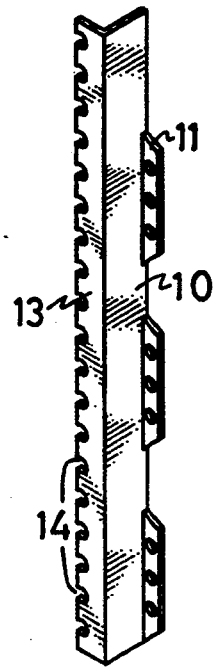
FIG. 4 is a perspective view of another embodiment of a stone mounting member in accordance with the present invention.
Figure 5:
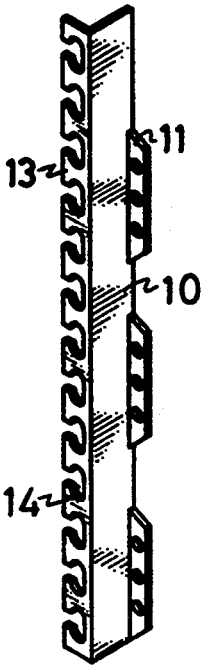
FIG. 5 is a perspective view of a further embodiment of a stone mounting member in accordance with the present invention.
Figure 6:
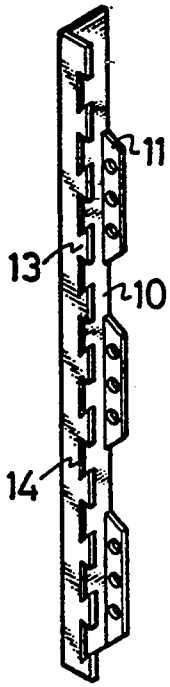
FIG. 6 is a perspective view of still another embodiment of a stone mounting member in accordance with the present invention.

FIG. 4 shows another embodiment of the mount 10 which defines a plurality of semi-circular recesses. FIG. 5 shows another embodiment of the mount 10 which defines a plurality of oval recesses. FIG. 6 shows another embodiment of the mount 10 wherein the stone-engaging means and the frame-engaging means project in identical directions from the body.

From the above description, it is clear that the present invention provides a mount which simplifies the procedure for mounting stones onto a wall, reduces the total cost, and improves the mounting speed (no experienced person is required). Furthermore, the maintenance for a single stone is convenient and possible without affecting other stones.

Although the invention has been explained in relation to its preferred embodiment, it is to be understood that many other possible modifications and variations can be made without departing from the spirit and scope of the invention as hereinafter claimed.

I claim:

1. An apparatus for mounting stones to a wall, comprising:

a plurality of stone/mounting combinations, each comprising:

a stone comprising two parallel edges in each of which a slit is defined therein; and two mounts, each comprising;

a body;

a stone-engaging means perpendicularly extending from an edge of the body, wherein the stone engaging means is secured in the slit by means of an adhesive material and comprises a plurality of recesses defined therein for enforcing the engagement between the stone-engaging means and the adhesive material;

a frame-engaging means perpendicularly extending from an opposite edge of the body, wherein the frame-engaging means comprises a plurality of spaced fins each defining apertures for receiving a corresponding number of screws for securing the stone/mount combination to a wall and the spaced fins of one stone/mount combination being fittingly mated to the spaced fins of an adjacent stone/mount combination.

2. A stone/mounting combination as claimed in claim 1 wherein the recesses are semi-circular.

3. A stone/mounting combination as claimed in claim 1 wherein the recesses are elliptic.

4. A stone/mounting combination as claimed in claim 1 wherein the recesses are each in the form of a dovetail.

* * * * *